US008016470B2

(12) United States Patent
Li et al.

(10) Patent No.: US 8,016,470 B2
(45) Date of Patent: Sep. 13, 2011

(54) LED-BASED DENTAL EXAM LAMP WITH VARIABLE CHROMATICITY

(75) Inventors: Wei Li, South Barrington, IL (US); Jamie Swayne, Lake Zurich, IL (US); Austin E. Unsworth, Fort Mill, SC (US); Nabil Dagher, Charlotte, NC (US); H. Thomas Lockamy, Charlotte, NC (US)

(73) Assignee: Dental Equipment, LLC, Charlotte, NC (US)

( * ) Notice: Subject to any disclaimer, the term of this patent is extended or adjusted under 35 U.S.C. 154(b) by 194 days.

(21) Appl. No.: 12/287,481

(22) Filed: Oct. 8, 2008

(65) Prior Publication Data

US 2009/0091913 A1 Apr. 9, 2009

Related U.S. Application Data

(63) Continuation-in-part of application No. 11/867,876, filed on Oct. 5, 2007, now abandoned.

(51) Int. Cl.
*F21V 13/00* (2006.01)

(52) U.S. Cl. ..... 362/573; 362/572; 362/294

(58) Field of Classification Search ..... 362/572, 362/573, 804, 231, 294, 373, 33, 580, 296.01, 362/296.06, 800; 433/29–31
See application file for complete search history.

(56) References Cited

U.S. PATENT DOCUMENTS 3,290,496 A 12/1966 Appleton
4,090,189 A 5/1978 Fisler
4,176,294 A 11/1979 Thornton, Jr.
4,254,455 A * 3/1981 Neal, Jr. ..... 362/296.03
4,298,911 A 11/1981 Headrick
4,368,406 A 1/1983 Kruzich et al.
4,399,541 A 8/1983 Kovats et al.
4,516,195 A 5/1985 Gonser
4,608,622 A 8/1986 Gonser (Continued)

FOREIGN PATENT DOCUMENTS

GB 2387025 10/2003

(Continued)

OTHER PUBLICATIONS

Prof. Laurence J. Walsh, LED Operating Lights in Dental Practice, Australasian Dental Practice, May/Jun. 2009, pp. 48-54.

(Continued)

*Primary Examiner* — Bao Q Truong
(74) *Attorney, Agent, or Firm* — Michael Best & Friedrich LLP

(57) ABSTRACT

An electrically powered light source including a light emitting diode (LED) having variable chromaticity, which is adapted for use in a dental operatory. A dental operatory lamp includes a thermally conductive housing having a front directed toward the operating area and a rear away from the operating area; a generally elliptical reflector located on the rear of the thermally conductive housing; at least one heat pipe; a plurality of color LEDs projecting light toward the elliptical reflector, the plurality of LEDs being in thermal contact with the at least one heat pipe; and an optical light guide for combining light from said LEDs. Another embodiment of the lamp includes at least two user selectable light spectra, one of said spectra providing white light with color temperature in the range 4000° K-6000° K and one spectra having reduced output in the wavelength range 400-500 nm.

20 Claims, 4 Drawing Sheets

U.S. PATENT DOCUMENTS 4,900,912 A 2/1990 Shoji
5,029,335 A 7/1991 Fisher et al.
5,136,483 A 8/1992 Schoniger et al.
5,301,090 A 4/1994 Hed
5,317,307 A 5/1994 Thomas, Jr.
5,406,176 A 4/1995 Sugden
5,420,482 A 5/1995 Phares
5,590,945 A 1/1997 Simms
5,607,217 A 3/1997 Hobbs, II
5,689,162 A 11/1997 Li
5,803,579 A 9/1998 Turnbull et al.
5,836,676 A 11/1998 Ando et al.
5,851,063 A 12/1998 Doughty et al.
5,926,658 A 7/1999 Tenmyo
6,002,424 A 12/1999 Rapa et al.
6,016,038 A 1/2000 Mueller et al.
6,120,164 A 9/2000 Libin et al.
6,127,783 A 10/2000 Pashley et al.
6,132,067 A * 10/2000 Scholz ..... 362/304
6,135,602 A * 10/2000 Chuang ..... 362/33
6,149,283 A 11/2000 Conway et al.
6,150,774 A 11/2000 Mueller et al.
6,176,597 B1 * 1/2001 Smith ..... 362/297
6,183,086 B1 2/2001 Neubert
6,211,626 B1 4/2001 Lys et al.
6,234,645 B1 5/2001 Borner et al.
6,238,076 B1 5/2001 Pascale et al.
6,290,368 B1 9/2001 Lehrer
6,337,946 B1 1/2002 McGaffigan
6,340,868 B1 1/2002 Lys et al.
6,350,041 B1 2/2002 Tarsa et al.
6,356,394 B1 3/2002 Glienicke
6,362,578 B1 3/2002 Swanson et al.
6,379,022 B1 4/2002 Amerson et al.
6,400,101 B1 6/2002 Biebl et al.
6,411,046 B1 6/2002 Muthu
6,441,558 B1 8/2002 Muthu et al.
6,441,940 B1 8/2002 Bylsma
6,445,139 B1 9/2002 Marshall et al.
6,459,919 B1 10/2002 Lys et al.
6,478,453 B2 11/2002 Lammers et al.
6,495,964 B1 12/2002 Muthu et al.
6,498,440 B2 12/2002 Stam et al.
6,507,159 B2 1/2003 Muthu
6,510,995 B2 1/2003 Muthu et al.
6,513,962 B1 2/2003 Mayshack et al.
6,526,078 B2 2/2003 Lee
6,536,914 B2 3/2003 Hoelen et al.
6,547,400 B1 4/2003 Yokoyama
6,552,495 B1 4/2003 Chang
6,560,038 B1 5/2003 Parkyn, Jr. et al.
6,567,009 B2 5/2003 Ohishi et al.
6,572,246 B1 6/2003 Hopp et al.
6,586,890 B2 7/2003 Min et al.
6,594,424 B2 7/2003 Schmidt et al.
6,596,977 B2 7/2003 Muthu et al.
6,608,614 B1 8/2003 Johnson
6,614,358 B1 9/2003 Hutchison et al.
6,630,801 B2 10/2003 Schuurmans
6,692,251 B1 2/2004 Logan et al.
6,692,252 B2 2/2004 Scott
6,719,446 B2 4/2004 Cao
6,741,351 B2 5/2004 Marshall et al.
6,747,420 B2 6/2004 Barth et al.
6,788,011 B2 9/2004 Mueller et al.
6,806,659 B1 10/2004 Mueller et al.
6,815,724 B2 11/2004 Dry
6,821,117 B2 * 11/2004 Burtscher et al. ..... 433/29
6,836,081 B2 12/2004 Swanson et al.
6,843,591 B1 1/2005 Peng et al.
6,864,641 B2 3/2005 Dygert
6,888,322 B2 5/2005 Dowling et al.
6,890,085 B2 5/2005 Hacker
6,890,108 B2 5/2005 Symanowski et al.
6,918,762 B2 * 7/2005 Gill et al. ..... 433/29
6,955,444 B2 10/2005 Gupta
6,964,490 B2 * 11/2005 Scholz ..... 362/33
6,965,205 B2 11/2005 Piepgras et al.
6,967,448 B2 11/2005 Morgan et al.
6,976,769 B2 12/2005 McCullough et al.
6,987,787 B1 1/2006 Mick
6,989,701 B2 1/2006 Lin et al.
7,008,078 B2 3/2006 Shimizu et al.
7,009,343 B2 3/2006 Lim et al.
7,014,336 B1 3/2006 Ducharme et al.
7,038,398 B1 5/2006 Lys et al.
7,048,412 B2 5/2006 Martin et al.
7,049,769 B2 5/2006 Boulouednine et al.
7,067,995 B2 6/2006 Gunter et al.
7,071,762 B2 7/2006 Xu et al.
7,093,952 B2 8/2006 Ono et al.
7,095,110 B2 8/2006 Arik et al.
7,111,972 B2 9/2006 Coushaine et al.
7,121,691 B2 10/2006 Coushaine et al.
7,132,785 B2 11/2006 Ducharme
7,140,752 B2 11/2006 Ashdown
7,157,694 B2 1/2007 May et al.
7,161,311 B2 1/2007 Mueller et al.
7,161,313 B2 1/2007 Piepgras et al.
7,172,319 B2 2/2007 Holder et al.
7,173,384 B2 2/2007 Plotz et al.
7,195,386 B2 3/2007 Imade
7,202,613 B2 4/2007 Morgan et al.
7,207,694 B1 * 4/2007 Petrick ..... 362/240
7,210,832 B2 5/2007 Huang
7,212,287 B2 5/2007 Jaffar et al.
7,217,009 B2 5/2007 Klose
7,218,824 B2 5/2007 Franklin et al.
7,246,921 B2 7/2007 Jacobson et al.
7,249,868 B2 7/2007 Chinniah et al.
7,255,457 B2 8/2007 Ducharme et al.
7,275,931 B2 10/2007 Katsuda et al.
7,425,077 B2 9/2008 Lockamy et al.
2003/0165055 A1 * 9/2003 Scholz ..... 362/33
2003/0215766 A1 11/2003 Fischer et al.
2004/0029069 A1 2/2004 Gill et al.
2004/0120162 A1 6/2004 Tsimerman et al.
2004/0141336 A1 7/2004 West et al.
2005/0099824 A1 5/2005 Dowling et al.
2005/0158687 A1 7/2005 Dahm
2006/0002135 A1 * 1/2006 Kokeny et al. ..... 362/573
2006/0245173 A1 11/2006 Lockamy et al.
2006/0245187 A1 11/2006 Scott et al.
2006/0285328 A1 * 12/2006 Syribeys ..... 362/257
2007/0024971 A1 * 2/2007 Cassarly et al. ..... 359/487
2007/0031777 A1 2/2007 Wang et al.
2008/0002402 A1 1/2008 Mandikos
2008/0025013 A1 1/2008 Lockamy et al.
2010/0203465 A1 8/2010 Bria et al.

FOREIGN PATENT DOCUMENTS

WO 2006074525 7/2006
WO 2009045223 4/2009
WO 2009045251 4/2009

OTHER PUBLICATIONS

Philips Lumileds, White Paper: Street Lighting, LEDs: Coming Soon to a Street Light Near You, Sep. 12, 2008 (7 pages).
Philips Lumileds, Technology White Paper: Understanding Power LED Lifetime Analysis, May 7, 2007 (11 pages).
Lumileds, Application Brief AB20-6: Reliability Consideration for SuperFlux LEDs, Sep. 2002 (11 pages).
International Search Report from PCT/US2008/009768, dated Nov. 5, 2008, 2 pages.
Written Opinion of the International Searching Authority from PCT/US2008/009768, dated Nov. 5, 2008, 4 pages.
International Search Report from PCT/US2007/080636, dated Mar. 28, 2008, 1 page.
Written Opinion of the International Searching Authority from PCT/US2007/080636, dated Mar. 28, 2008, 6 pages.
Prof. Laurence J. Walsh, The University of Queensland—School of Dentistry, Letter to TraskBritt, dated 2009/2010 (1 page).

* cited by examiner

LED-BASED DENTAL EXAM LAMP WITH VARIABLE CHROMATICITY

RELATED U.S. APPLICATION DATA

This application is a continuation-in-part of application Ser. No. 11/867,876, filed Oct. 5, 2007, now abandoned published as Pub. No. US 2008/0025013 A1 on Jan. 31, 2008. The disclosure of the previously referenced U.S. patent application is hereby incorporated herein by reference in its entirety.

TECHNICAL FIELD

This invention relates to apparatus that produce visible light. It is particularly directed to an electrically powered light source including a light emitting diode (LED) having variable chromaticity, which is adapted for use in a dental operatory.

BACKGROUND

It has been known for an extended period of time that electricity may be harnessed to create visible light. Incandescent light emitting elements powered by electricity have been used for substantially the same period of time. However, such incandescent lights suffer from an inefficient conversion of electricity to visible light. The inefficient conversion process causes production of a considerable amount of heat, and emission of a significant amount of radiation in, or near, the infrared spectrum. Such infrared emission inherently casts a heat load onto a target along with an illuminating beam. The heat generated by incandescent lighting may sometimes place an undesirable burden on environmental control systems, such as cooling systems used in dwellings. Both the inefficient conversion process, and removing the undesired heat load from the area near the light, lead to a correspondingly larger than necessary electric utility bill. Furthermore, in use on an operatory to illuminate an operating site on a patient, the infrared emissions may undesirably dry illuminated tissue, or may produce a feeling of discomfort in the patient.

Alternative light emitting elements include fluorescent light bulbs. Such fluorescent bulbs advantageously produce a reduced heat load compared to incandescent bulbs. However, fluorescent bulbs tend to be bulky, and generally produce light of a less desirable color and intensity for many applications. Furthermore, certain electrical components required in the electric circuit powering the fluorescent bulbs, such as the ballast, tend to produce an undesirable amount of noise. In use in an operatory, it is generally desired to reduce the bulk of a lamp fixture, to reduce its intrusion into the operating arena, and to facilitate ease of manipulation of the lamp fixture.

The majority of currently marketed dental exam lights use incandescent bulbs as light sources. These incandescent dental exam lights possess a number of disadvantages, such as: emission of infra-red (IR) radiation that must be removed with filters or so-called 'cold-mirrors' to prevent excessive warming of the patient and user; relatively short bulb lifetime; inability of the user to adjust light color temperature and chromaticity of light; color temperature becoming lower and the light becoming "warmer" (i.e., shifting from white to orange/red), when light intensity is reduced (dimmed); and production of significant ultraviolet (UV) and blue light which causes undesired and uncontrolled curing of dental composites and adhesives.

It would be an improvement to provide a more energy-efficient lamp fixture capable of producing a reduced heat load, and casting illumination having a desirable color and intensity that can be adjusted to obtain desirable spectra in a single lamp.

BRIEF SUMMARY OF THE INVENTION

A particular embodiment of the invention includes a dental operatory lamp used to illuminate an operating area which comprises a thermally conductive housing having a front directed toward the operating area and a rear away from the operating area; a generally elliptical reflector located on the rear of the thermally conductive housing; at least one heat pipe; a plurality of color LEDs projecting light toward the elliptical reflector, the plurality of LEDs being in thermal contact with the at least one heat pipe; and an optical light guide for combining light from said LEDs.

Another embodiment of the invention is drawn to a dental operatory lamp used to illuminate an operating area that includes: a plurality of color LEDs; an optical light guide for combining light from said LEDs; and at least two user selectable light spectra, one of said spectra providing white light with color temperature in the range 4000° K-6000° K and one spectra having reduced output in the wavelength range 400-500 nm.

Yet another embodiment of the invention relates to a dental operatory lamp used to illuminate an operating area that includes: a housing having a front directed toward the operating area and a rear away from the operating area; a reflector module located at the rear of the housing; a plurality of color light emitting diodes (LEDs) on the reflector module; and an optical light guide configured to direct the light from the color LEDs toward the front of the lamp in a pattern that focuses white light from the lamp to a central area of illumination of high intensity, with significantly reduced intensity illumination outside the central area.

BRIEF DESCRIPTION OF THE SEVERAL VIEWS OF THE DRAWINGS

While the specification concludes with claims particularly pointing out and distinctly claiming that which is regarded as the present invention, this invention can be more readily understood and appreciated by one of ordinary skill in the art from the following description of the invention when read in conjunction with the accompanying drawings in which:

DETAILED DESCRIPTION OF THE INVENTION

Although the foregoing description contains many specifics, these should not be construed as limiting the scope of the present invention, but merely as providing illustrations of some representative embodiments. Similarly, other embodiments of the invention may be devised that do not depart from the spirit or scope of the present invention. Features from different embodiments may be employed in combination.

Figure 1:
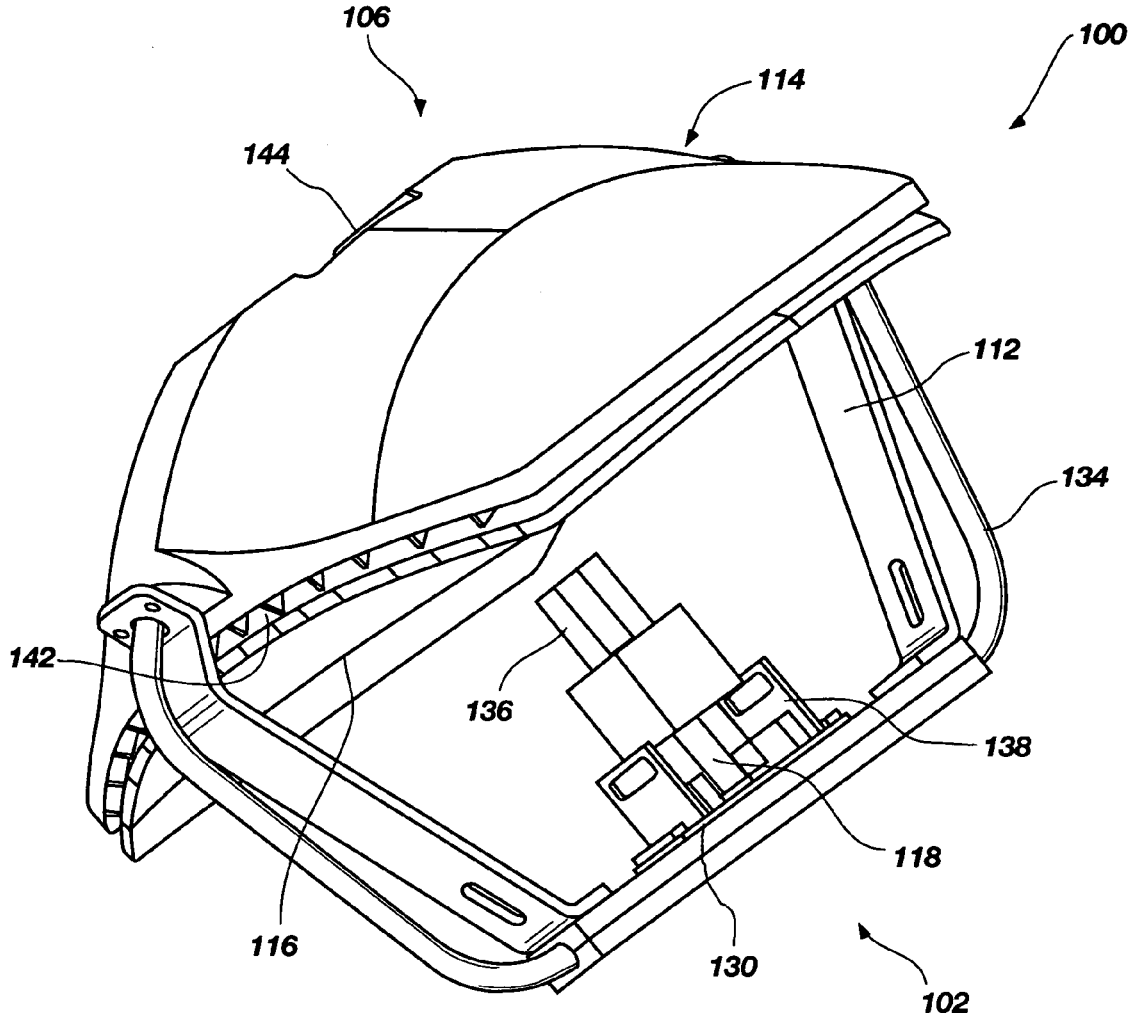
FIG. 1 is a perspective view of a dental operatory lamp according to a particular embodiment of the invention.

FIG. 1 illustrates a perspective view of a current embodiment of the invention, generally indicated at 100, of a light source structure constructed according to principles of the invention. Light source structure 100 may generally be characterized as a lamp. Lamp 100 is powered by electricity, and functions to provide illumination to a work area disposed a distance from the lamp front, generally indicated at 102. Desirably, the work area illuminated by lamp 100 is shadow-free, and appears relatively uniform in illumination color and intensity. For most applications, the illuminated target work area is considered to have an approximately flat footprint and a depth normal to that footprint. That is, the illuminated region is generally structured to encompass a volume disposed proximate the footprint.

Illustrated lamp 100 can include an attachment structure (not shown) operable to connect lamp 100 to suspension structure in the work area. Such an attachment structure is typically attached at a back 106 of lamp 100, although any convenient arrangement is operable. Typical suspension structure in a dental operatory permits a user to orient the lamp in space operably to aim the light output of lamp 100 at the desired target area. Certain embodiments of the invention provide a lamp having reduced weight and/or intrusive volume compared to commercially available lamps. Such reduced weight lamps permit a corresponding reduction in mass of the lamp suspension arrangement, thereby increasing ease of manipulation of the lamp to orient its output toward a target.

In use in an environment such as a dental operatory, a front shield (not shown) can be provided as a protective cover to block migration of dust and contaminated aerosols into the lamp interior. A front surface of such a shield may be structured to provide an easily cleanable surface, whereby to maintain sterility of the operatory area. In certain embodiments, the shield may incorporate one or more lenses to focus, or otherwise modify, the light output of lamp 100. Whether or not a focusing lens is provided, a shield made from Lexan®, or other similar optically useful and formable material, can be provided to completely encase the front of a dental lamp to resist contamination of, and to facilitate cleaning of, the lamp. The shield may be injection molded and may include focusing lenses. Desirably, the shield, or a portion of lamp housing 114, can be hinged, or otherwise openable by a user, to provide access to the interior of lamp 100 for maintenance or replacement of a light generating element.

Figure 2:
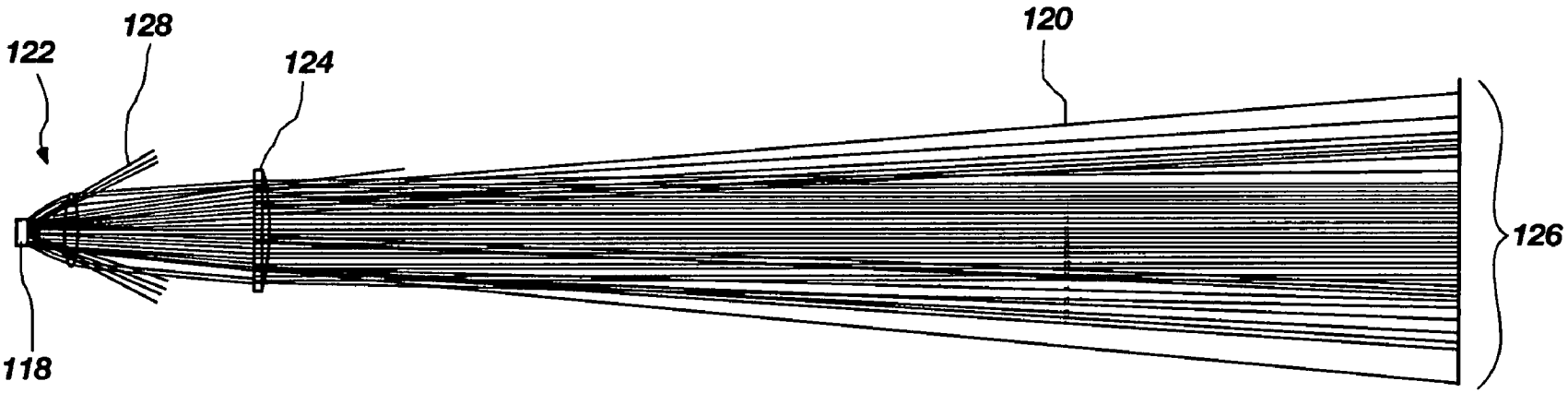
FIG. 2 illustrates a component arrangement and a representative LED light output in a dental operatory lamp.

With reference to FIG. 2, an LED 118 emits light indicated by a plurality of rays 120. An operable LED can include a 3 watt LED, such as that sold by Lumileds Lighting US, LLC under the Brand name Luxeon, part number LXHL-LW3C.

Typically, a reflective element, generally indicated at 116, is provided to direct the LED's light output toward a target. In a particular embodiment, reflective element 116 can be a concave aspheric reflector which collects the light emanating from the mixing rod and focuses it onto the plane of the patient's face ("image plane"). The reflector surface contour can be a simple 2D ellipse section revolved around the central optical axis. A focusing lens 122 may be included in an arrangement effective to collimate rays 120 and further direct them to an illuminated area indicated at 126. In certain embodiments of the invention, area 126 corresponds to the target footprint of the lamp 100. In such case, it is desired that the illumination emitted from each module 108 is substantially uniform over area 126. Certain rays 128 may be emitted in a direction other than desired for impingement on area 126. Such rays 128 are characterized as stray light. As indicated by the illustrated collection of rays 120, area 126 sometimes has a higher intensity of illumination at its center, and may fade to a decreased intensity near its perimeter, as discussed with reference to FIG. 4. In another embodiment, the LED 118, mirror 122, and all associated optics are arranged in harmony to produce a substantially uniform intensity over its illuminated footprint at a selected focal distance.

LEDs 118 are typically mounted onto a bracket 112 associated with lamp housing 114. Desirably, the bracket 112 assembly is structured to provide simple and rapid installation and removal of LED 118, and includes connection structure for the electricity supplied to the LED and may further include a metal core circuit board 130. It is further desirable for bracket 112 to be formed from a material capable of conducting heat or, alternatively, to be associated with heat conducting pipes 134. Advantageously, bracket 112 and/or heat pipe 134, together with housing 132 may be structured and arranged to dissipate any heat generated by LED 118 in a direction away from the front 102 of the lamp 100. In some embodiments, use of heat pipe 134 is particularly desirable since a large heat sink positioned directly behind the metal core board with the heat-generating LEDs may significantly obscure the light focusing onto the image plane. Through use of a heat pipe 134 or equivalent structure, the heat can be conducted away via heat pipes 134 to a heat sink housing positioned on the back of the reflector where it does not obscure the light. An exemplary heat sink housing can include heat sink fins 142. The heat sink fins 142 can be integral with the outer housing of the lamp and constructed of any heat conducting or dissipating material, such as cast aluminum. To increase cooling, a fan can be used to draw air into a gap 144 between the reflector and the heat sink housing. To maximize surface area and thus cooling, the inside of the heat sink/housing includes fins or ribs 142 that form air channels therebetween.

Figure 3:
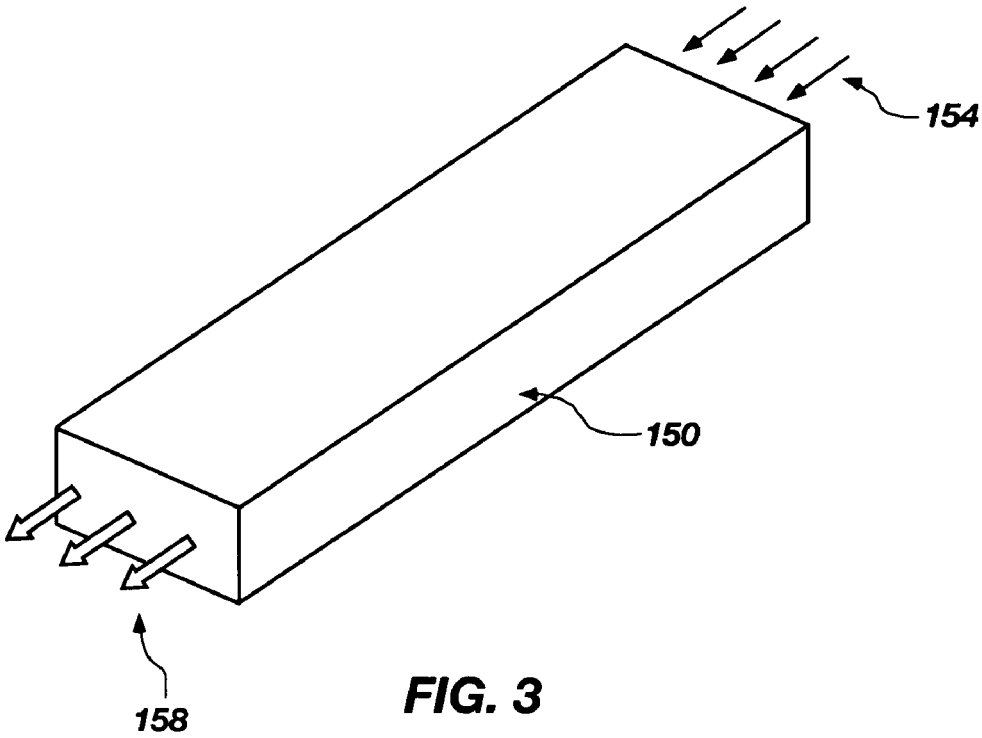
FIG. 3 illustrates an embodiment of an optical light guide in a dental operatory lamp of the invention.

In order to produce homogenous light from multiple LEDs of different colors (for example, red, greed, blue, and amber), the light emitting from each individual LED should sufficiently overlap the light from all the other LEDs. In a particular embodiment, a clear rectangular rod made of acrylic serves this function and is referred to herein as an optical light guide or a light mixing rod 136. It is understood that the mixing rod 136 can be made out of any suitable material capable of acting as an optical light guide. The performance of the mixing rod 136 can be significantly enhanced with the addition of periodic features or "ripples" 150 on the outside walls of the mixing rod, as shown in FIGS. 1 and 3. As illustrated in FIG. 3, light from multiple LEDs of different colors 154 (e.g., red, green, blue, and/or amber) are introduced through one end of the mixing rod 136 and emanate from another end of the mixing rod 136 as a composite white light 158. One particular embodiment combines the light from four different colored LEDs (red, blue, green, and amber) to produce white light. By varying the ratios of the different colors, the character of the white light can be changed. Specifically, white light with coordinated color temperatures (CCTs) of 4200° K and 5000° K can be produced while maintaining a high color rendering index (CRI), typically in excess of 75. Blue light typically occurs in the peak wavelength range of 445 nm to 465 nm. Green light typically occurs in the dominant wavelength range of 520 nm to 550 nm, amber light in the range of 584 nm to 597 nm, and red light in the range of 613 nm to 645 nm. A rod support 138 can be used to secure mixing rod 136 in place.

Multiple LEDs of each color can be mounted using reflow surface mount techniques to achieve optimum optical density. In a particular embodiment, a conventional metal core board (MCB) 130 can be used. Alternatively, a conventional fiberglass laminate (FR4) printed circuit board (PCB) material can be used. LEDs, particularly red and amber LEDs, have the characteristic that their light output decreases significantly as their temperature raises. Heat management can be critical to maintaining optimum light output and therefore the proper ratios of light intensity to maintain the desired CCT and CRI.

The lamp 100 of the present invention includes a number of different operating modes which provide different light characteristics, as described in Table 1.

TABLE 1

| Mode | Nominal CCT (° K) | CRI | Approximate relative peak intensity Blue | Green | Amber | Red | Comments |
|---|---|---|---|---|---|---|---|
| "Cool white" | 5,000 | 70+ | 0.72 | 0.70 | 0.75 | 1.00 | Meets European user preference for cooler white light. |
| "Warm white" | 4,200 | 70+ | 1.00 | 0.80 | 0.75 | 1.00 | Meets U.S. user preference for warmer white light. |
| "No-cure" | N/A | N/A | ~0 | 0.30 | 0.60 | 1.00 | Greatly reduced flux below 500 nm will not cure dental adhesives. |

In this design, the ratios of the four colors are controlled with a variation of pulsed width modulation of the current. During the assembly and test of the lamp 100, each color is independently characterized for peak wavelength, spectral spread (full width half max), and illuminance (lux) at the image plane at a predetermined maximum current. Using test software based on both theoretical and empirical predictions, these values are used to generate a table of duty cycles for each wavelength at each of the three operating conditions: 4200K, 5000K, and "No Cure" modes at start up (board temperature equal to ambient temperature). These tables then can be stored on an electronic memory device (chip) that matches the serial number of the lamp. The PWM controller then looks up the duty cycle table on the memory chip and sets the duty cycles accordingly when the lamp is first started. At this time, the test software algorithm can also produce and store duty cycle tables for the full range of operating board temperatures, as discussed in more detail below.

In a particular embodiment of the invention, temperature compensation or measurement may be included. Since each color LED has a different sensitivity to heat, a compensation algorithm can be used to set the drive current values for each color as a function of temperature. The compensation algorithm may be adapted to assume that LEDs of a given color do not exhibit significant differences in temperature sensitivity. As a result, each lamp need not be characterized thermally but rather may depend on the theoretical and empirically determined temperature relationships in the algorithm. A thermistor on the LED circuit board may also be included to measure actual board temperature from which the LED temperature can be derived, based on previously determined empirical values, and the current to each LED color can be adjusted accordingly by software.

In another embodiment, a dental operatory lamp used to illuminate an operating area comprises a housing having a front directed toward the operating area and a rear away from the operating area, and a reflector module located at the rear of the housing. An electrical power supply is provided for supplying electrical power to the LEDs for illuminating the LEDs, with the power supply being selectively operable to provide an intensity adjustment for the LEDs. The electrical power supply can be selectively operable to control the level of power transmitted to each LED independent of the level of power transmitted to the other LEDs. The lamp can be configured to have a variable color output. For example, the intensity adjustment can range from 0 to about 2500 FC. The intensity adjustment can be continuous throughout its range of adjustments or, alternatively, can be adjustable at discrete settings within its range of adjustments. The lamp may further include a microprocessor in communication with the LEDs to control the level of power transmitted to the LEDs, and thus the output intensity of the light from the lamp. Suitable microprocessors for use with the present invention are well known in the art and include, but are not limited to, any programmable digital electronic component that incorporates the functions of a central processing unit (CPU) on a single semiconducting integrated circuit (IC).

In an alternative embodiment of the invention, a dental operatory lamp used to illuminate an operating area comprises a housing having a front directed toward the operating area and a rear facing away from the operating area. A plurality of light emitting diodes (LEDs) can be included. An adapter configured for receiving at least one non-light emitting diode (non-LED) light source is located within the housing. The at least one non-LED light source may consist of a group of lights that can be selected from, for example, Quartz halogen, tungsten halogen, incandescent, xenon, fluorescent, fiber optics, gas plasma, laser, ultraviolet, and blue light. The at least one non-LED light source may also include the group of lights selected from, for example, dental curing light, oral cancer screening light, decay detection (cavities and caries) blood detection sterilization and tooth whitening light.

Figure 4:
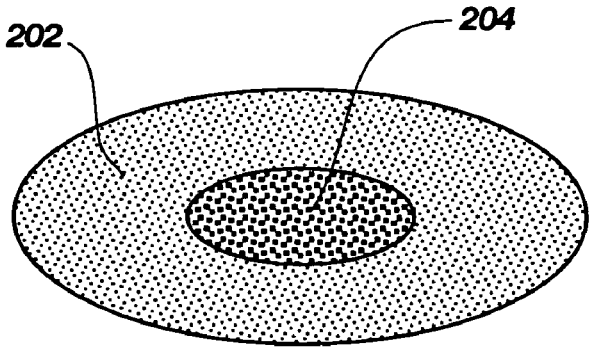
FIG. 4 illustrates a representative illumination pattern for the dental operatory lamp according to one embodiment of the invention.

A particular embodiment of the invention includes a dental operatory lamp used to illuminate an operating area having a housing with a front directed toward the operating area and a rear away from the operating area. The LEDs 118 are positioned with their longitudinal axes aligned toward predetermined points on the reflective element 116 for directing the light from the LEDs 118 toward the front of the lamp in a pattern that focuses light from the lamp to a central area of illumination of high intensity 204, with significantly reduced intensity illumination 202 outside the central area, as shown in FIG. 4. Particular representative patterns of focused light emanating from the dental operatory lamps of the present invention include, for example, a pattern of focused light that can be elliptically shaped and may be about 3 inches by about 6 inches (7.62 cm by about 15.24 cm) in size. In a particular embodiment, the reduced intensity illumination 202 outside the central area of illumination 204 decreases in intensity by 50% of a maximum intensity relative to the central area of illumination of high intensity. The central area of illumination of high intensity 204 can have a pattern size of at least 50 mm by 25 mm. The reduced intensity illumination 202 outside the central area can be configured to decrease in intensity progressively and smoothly relative to the central area of illumination of high intensity. The pattern can be configured to have a brightness of greater than about 20,000 Lux at a focus height of 700 mm from a target. The illumination on the central area of illumination of high intensity 204 at a distance of 60 mm can be configured to be less than about 1200 Lux. Illumination at the maximum level of the dental operating light in the spectral region of 180 nm to 400 nm can be configured to not exceed 0.008 W/m2.

Figure 5:
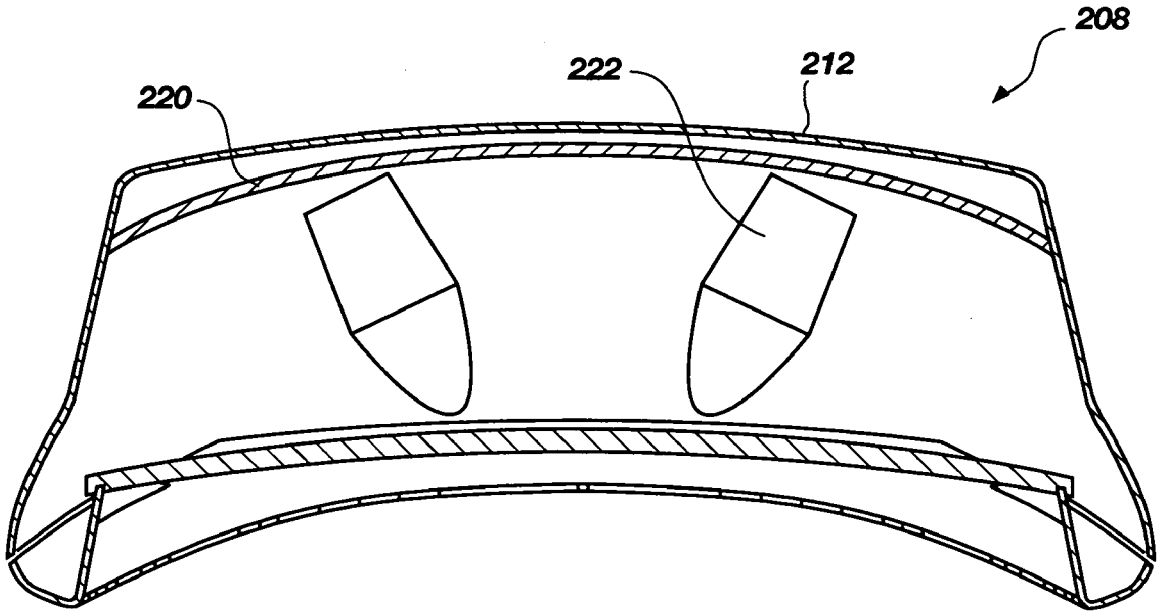
FIG. 5 is a cross-section of a light module having a reflective interior reflective surface according to a particular embodiment of the invention.

Yet another embodiment of the invention is shown in FIG. 5, wherein a dental operatory lamp used to illuminate an operating area includes a lamp assembly 208 having a front 210 directed toward the operating area and a rear 212 away from the operating area. A reflector module 220 can be located within the lamp assembly 208, and more specifically, can be located at the rear 212 of the lamp assembly 208. A plurality of light emitting diodes (LEDs) can optionally be located in a reflector module 222. Optionally, a light mixing rod (not shown) may be included as part of the reflector module 222 to produce homogenous light from the multiple LEDs of different colors. The lamp assembly 208 can include a curved or faceted interior reflective surface 220. The LEDs can be directed toward the curved or faceted interior reflective surface 220 for directing the light from the LEDs toward the front 210 of the lamp in a pattern that focuses light from the lamp to a central area of illumination of high intensity, with significantly reduced intensity illumination outside the central area. The reduced intensity illumination outside the central area can be configured to decrease in intensity by 50% of a maximum intensity relative to the central area of illumination of high intensity. The reduced intensity illumination outside the central area may be configured to decrease in intensity progressively and smoothly relative to the central area of illumination of high intensity. The light pattern can have a brightness of greater than about 20,000 Lux at a focus height of 700 mm from a target. The illumination on the central area of illumination of high intensity at a distance of 60 mm may be less than about 1200 Lux. The illumination at the maximum level of the dental operating light in the spectral region of 180 nm to 400 nm may be configured to not exceed 0.008 $W/m^2$.

The lamp 100 of the present invention allows the user to set various chromaticity settings, such as sunlight equivalent D65 or simulated fluorescent lighting for improved dental shade matching. It also allows the addition of thermal, color, or intensity feedback to better maintain light characteristics over the life of the product, and permits adjustment of light intensity independent of color setting. The lamp 100 also is adapted to provide different configurations and forms of color mixing light guides. Specifically, the lamp 100 provides a user selectable mode with reduced irradiance in the near UV and blue wavelengths to allow adequate illumination while not initiating curing of UV-curable dental composites and adhesives. The lamp design can provide longer life through use of LEDs instead of incandescent bulbs and which can be further achieved through use of heat pipes, finned rear housing and fan cooling which maintain low LED temperature even at high currents.

Although the foregoing description contains many specifics, these are not to be construed as limiting the scope of the present invention, but merely as providing certain representative embodiments. Similarly, other embodiments of the invention can be devised which do not depart from the spirit or scope of the present invention. The scope of the invention is, therefore, indicated and limited only by the appended claims and their legal equivalents, rather than by the foregoing description. All additions, deletions, and modifications to the invention, as disclosed herein, which fall within the meaning and scope of the claims, are encompassed by the present invention.

What is claimed is:

1. A dental operatory lamp used to illuminate an operating area comprising:

a thermally conductive housing having a front directed toward the operating area and a rear away from the operating area;

a generally elliptical reflector located on the rear of the thermally conductive housing, wherein the generally elliptical reflector is shaped to direct the light from the LEDs toward the front of the lamp in a pattern that focuses light from the lamp to a central area of illumination of high intensity, with significantly reduced intensity illumination outside the central area;

a plurality of color LEDs projecting light toward the elliptical reflector and toward the back of the thermally conductive housing; and an optical light guide for combining light from said LEDs.

2. The dental operatory lamp of claim 1, wherein the plurality of color LEDs comprises LEDs that emit at least three colors.

3. The dental operatory lamp of claim 1, wherein the plurality of color LEDs comprises LEDs that emit red, blue, green, and amber light wavelengths.

4. The dental operatory lamp of claim 1, wherein the optical light guide produces at least three operating modes with different light characteristics.

5. The dental operatory lamp of claim 4, wherein the at least three operating modes include a cool white mode, a warm white mode, and a no cure mode.

6. The dental operatory lamp of claim 4, further comprising at least two user selectable light spectra, a first spectra providing white light with color temperature in the range 4000° K-6000° K and a second spectra having reduced output in the wavelength range 400-500 nm.

7. The dental operatory lamp of claim 1, wherein the thermally conductive housing comprises cooling air channels formed between the reflector and the rear of the thermally conductive housing.

8. The dental operatory lamp of claim 7, wherein the cooling air channels are formed by fins.

9. A dental operatory lamp used to illuminate an operating area comprising:

a thermally conductive housing having a front directed toward the operating area and a rear away from the operating area;

a generally elliptical reflector located on the rear of the thermally conductive housing;

at least one heat pipe;

a plurality of color LEDs being in thermal contact with the at least one heat pipe; and an optical light guide for combining light from said LEDs, wherein the optical light guide directs the light from the LEDs toward the front of the lamp in a pattern that focuses light from the lamp to a central area of illumination of high intensity, with significantly reduced intensity illumination outside the central area.

10. The dental operatory lamp of claim 1, further comprising an electrical power supply for supplying electrical power to the LEDs for illuminating the LEDs, with the power supply being selectively operable to provide an intensity adjustment for the LEDs.

11. The dental operatory lamp of claim 1, further comprising an adapter configured for receiving at least one non-light emitting diode (non-LED) light source within the housing.

12. The dental operatory lamp of claim 1, further comprising a fan located at the rear of the thermally conductive housing.

13. The dental operatory lamp of claim 1, wherein the optical light guide comprises periodic features on an exterior surface thereof.

14. The dental operatory lamp of claim 1, wherein the lamp produces white light with coordinated color temperatures of between 4200° K and 5000° K, and maintaining a color rendering index in excess of 75.

15. The dental operatory lamp of claim 1, further comprising at least two user selectable light spectra, one of said spectra providing white light with color temperature in the range 4000° K-6000° K and one spectra having reduced output in the wavelength range 400-500 nm.

16. The dental operatory lamp of claim 15, wherein the user selectable light spectra comprises varying ratios of at least three colors emanating from the color LEDs.

17. The dental operatory lamp of claim 15, wherein the user selectable light spectra comprises various ratios of red, blue, green, and amber light emanating from the color LEDs.

18. The dental operatory lamp of claim 9, wherein the plurality of color LEDs comprises LEDs that emit at least three colors.

19. The dental operatory lamp of claim 9, wherein the optical light guide produces at least three operating modes with different light characteristics.

20. The dental operatory lamp of claim 9, wherein the lamp produces white light with coordinated color temperatures of between 4200° K and 5000° K, and maintaining a color rendering index in excess of 75.

* * * * *